US006109482A

United States Patent [19]

Briggs

[11] Patent Number: 6,109,482

[45] Date of Patent: Aug. 29, 2000

[54] DEVICE FOR DISPENSING LIQUID FROM A BOTTLE

[76] Inventor: Travis M. Briggs, 901 N. 60 East, Orem, Utah 84057

[21] Appl. No.: 09/176,846

[22] Filed: Oct. 22, 1998

[51] Int. Cl.[7] ..... B67D 5/06

[52] U.S. Cl. ..... 222/185.1; 222/132; 222/511; 222/518

[58] Field of Search ..... 222/181.1, 181.3, 222/185.1, 481, 482, 325, 518, 132, 511, 561

[56] References Cited

U.S. PATENT DOCUMENTS

| | | | |
|---|---|---|---|
| 3,584,834 | 6/1971 | Reid et al. | 222/518 X |
| 3,666,150 | 5/1972 | Liljeholm | 222/518 X |
| 4,026,442 | 5/1977 | Orton | 222/511 |
| 4,386,718 | 6/1983 | Stewart et al. | 222/185.1 |
| 4,715,516 | 12/1987 | Salvail | 222/185.1 X |
| 4,877,159 | 10/1989 | Strand | 222/518 X |
| 5,842,606 | 12/1998 | DeVito | 222/132 |

*Primary Examiner*—Kevin Shaver
*Assistant Examiner*—Eric Keasel

[57] ABSTRACT

A soda dispensing assembly is provided including a base having a recess formed therein for receiving a neck of an inverted soda bottle to receive fluid therefrom. A spigot has a top end coupled to a bottom of the recess and a bottom end extending therefrom so as to exit the base and terminate in an open end. Also included is a valve mechanism for selectively allowing fluid to flow from the open end of the spigot.

11 Claims, 3 Drawing Sheets

DEVICE FOR DISPENSING LIQUID FROM A BOTTLE

BACKGROUND OF THE INVENTION

1. Field of the Invention

The present invention relates to bottle holders and more particularly pertains to a new soda dispenser for conveniently dispensing soda from a 2-liter bottle or the like.

2. Description of the Prior Art

The use of bottle holders is known in the prior art. More specifically, bottle holders heretofore devised and utilized are known to consist basically of familiar, expected and obvious structural configurations, notwithstanding the myriad of designs encompassed by the crowded prior art which have been developed for the fulfillment of countless objectives and requirements.

Known prior art bottle holders include U. S. Pat. No. 2,536,419; U.S. Pat. No. 5,065,966; U.S. Pat. Des. 343,767; U.S. Pat. No. 5,172,832; U.S. Pat. No. 5,560,406; and U.S. Pat. No. 4,723,671.

In these respects, the soda dispenser according to the present invention substantially departs from the conventional concepts and designs of the prior art, and in so doing provides an apparatus primarily developed for the purpose of conveniently dispensing soda from a 2-liter bottle or the like.

SUMMARY OF THE INVENTION

In view of the foregoing disadvantages inherent in the known types of bottle holders now present in the prior art, the present invention provides a new soda dispenser construction wherein the same can be utilized for conveniently dispensing soda from a 2-liter bottle or the like.

The general purpose of the present invention, which will be described subsequently in greater detail, is to provide a new soda dispenser apparatus and method which has many of the advantages of the bottle holders mentioned heretofore and many novel features that result in a new soda dispenser which is not anticipated, rendered obvious, suggested, or even implied by any of the prior art bottle holders, either alone or in any combination thereof.

To attain this, the present invention generally comprises a plurality of dispensing assemblies. Each of such dispensing assemblies includes a base with a rectilinear configuration. As shown in FIG. 1, the base has a planar square top face, a planar square bottom face and a thin periphery formed of four side walls for defining an interior space. FIG. 3 depicts the top face of the base having a threaded recess formed therein. A tapering spigot includes a top end coupled to a bottom of the threaded recess and a bottom end extending downwardly and outwardly so as to exit the interior space of the base via a bottom edge of one of the side walls of the base. With reference again to FIG. 1, the bottom face of the base has four legs each mounted on one of four corners of the bottom face and extending downwardly therefrom. Next provided is a valve mechanism including a bore formed in the side wall from which the spigot exits. As shown in FIG. 3, a horizontally oriented sleeve is mounted on an intermediate extent of the spigot with an open end in communication with an interior of the spigot. Such sleeve is further in line with the bore of the side wall and an aperture formed in an opposite side of the spigot. A push member is slidably situated through the aperture of the spigot and has a first end slidably situated within the sleeve. A second end of the push member extends from the bore of the side wall. An angled conduit extends through the push member for reasons that will soon become apparent. Lastly, a stopper is coupled to the push member adjacent to the second end and situated within the interior space of the base. During use, the push member has a first orientation with the stopper abutting the side wall of the base. In the first orientation, the conduit of the push member remains out of alignment with the spigot to preclude the flow of fluid therethrough. In a second orientation upon the depression of the second end of the push member, the conduit is maintained in alignment with the spigot to allow the flow of fluid therethrough. In the preferred embodiment, a spring is situated within the sleeve which abuts the push member. The spring urges the push member into the first orientation during use. As shown in FIGS. 1 & 2, a frame is mounted on the base of each dispensing assembly. Each frame includes four elongated stanchions each mounted on one of four corners of the top face of the base. The stanchions extend upwardly from the base in a vertical direction. Connected between top ends of the stanchions are four short interconnect rods which together define a square. Two of the stanchions have a vertically oriented clamp mounted on a central extent thereof. Such clamps are each equipped with a C-shaped cross-section along their length. Another two of the stanchions have a vertically oriented cylindrical post mounted on their central extent. By this structure, the dispensing assemblies are removably coupled in a side-by-side relationship by way of the couples in a manner illustrated in FIG. 4. When the dispensing assemblies are interconnected, the spigots preferably extend in a similar direction for convenient use.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new soda dispenser apparatus and method which has many of the advantages of the bottle holders mentioned heretofore and many novel features that result in a new soda dispenser which is not anticipated, rendered obvious, suggested, or even implied by any of the prior art bottle holders, either alone or in any combination thereof.

It is another object of the present invention to provide a new soda dispenser which may be easily and efficiently manufactured and marketed.

It is a further object of the present invention to provide a new soda dispenser which is of a durable and reliable construction.

An even further object of the present invention is to provide a new soda dispenser which is susceptible of a low cost of manufacture with regard to both materials and labor, and which accordingly is then susceptible of low prices of sale to the consuming public, thereby making such soda dispenser economically available to the buying public.

Still yet another object of the present invention is to provide a new soda dispenser which provides in the apparatuses and methods of the prior art some of the advantages thereof, while simultaneously overcoming some of the disadvantages normally associated therewith.

Still another object of the present invention is to provide a new soda dispenser for conveniently dispensing soda from a 2-liter bottle or the like.

Even still another object of the present invention is to provide a new soda dispenser that includes a base having a recess formed therein for receiving a neck of an inverted soda bottle to receive fluid therefrom. A spigot has a top end coupled to a bottom of the recess and a bottom end extending therefrom so as to exit the base and terminate in an open end. Also included is a valve mechanism for selectively allowing fluid to flow from the open end of the spigot.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
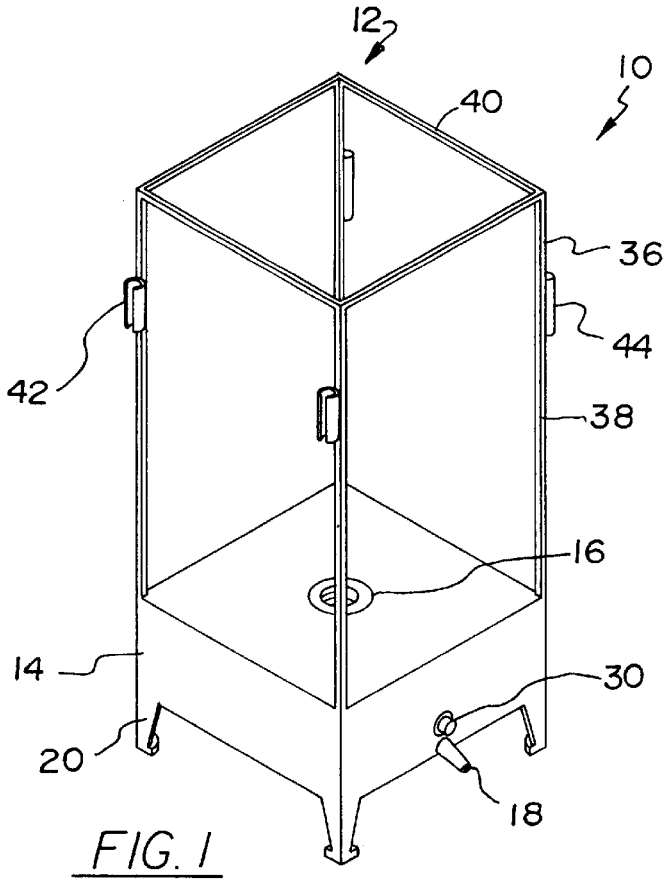
FIG. 1 is a perspective view of a new soda dispenser according to the present invention.

With reference now to the drawings, and in particular to FIGS. 1 through 6 thereof, a new soda dispenser embodying the principles and concepts of the present invention and generally designated by the reference numeral 10 will be described.

Figure 3:
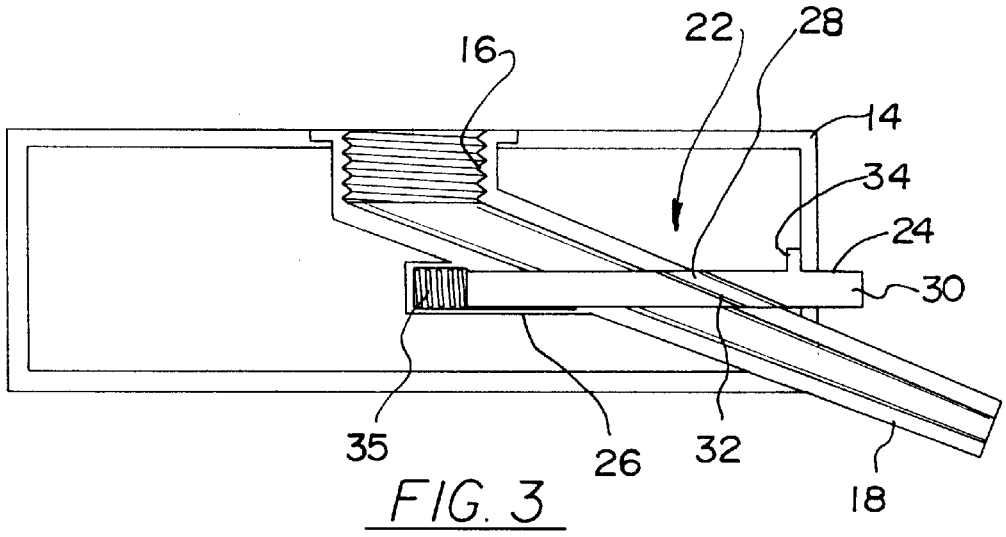
FIG. 3 is a side cross-sectional view of the base and valve mechanism of one of the dispensing assemblies taken along line 3—3 shown in FIG. 2.

The present invention, designated as numeral 10, includes a plurality of dispensing assemblies 12. Each of such dispensing assemblies includes a base 14 with a rectilinear configuration. As shown in FIG. 1, the base has a planar square top face, a planar square bottom face and a thin periphery formed of four side walls for defining an interior space. FIG. 3 depicts the top face of the base having a threaded recess 16 formed therein. Such threaded recess is preferably equipped with an elastomeric washer for threadedly engaging a neck of a 2-liter soda bottle in a sealed manner.

The base of each dispensing assembly also includes a tapering spigot 18 with a top end coupled to a bottom of the threaded recess. A bottom end of the spigot extends downwardly and outwardly so as to exit the interior space of the base via a bottom edge of one of the side walls of the base. With reference again to FIG. 1, the bottom face of the base has four legs 20 each mounted on one of four corners of the bottom face and extending downwardly therefrom. Ideally, each leg terminates in an inwardly extending foot.

Next provided is a valve mechanism 22 including a bore 24 formed in the side wall of the base from which the spigot exits. As shown in FIG. 3, a horizontally oriented sleeve 26 is mounted on an intermediate extent of the spigot with an open end in communication with an interior of the spigot. Such sleeve is further in line with the bore 24 of the side wall and an aperture 28 formed in an opposite side of the spigot. A push member 30 is slidably situated through the aperture of the spigot and has a first end slidably situated within the sleeve. Ideally, a gasket is employed about a periphery of the aperture for sealing purposes. A second end of the push member extends from the bore of the side wall of the base. An angled conduit 32 extends through the push member for reasons that will soon become apparent. Lastly, a stopper 34 is coupled to the push member adjacent to the second end and situated within the interior space of the base.

During use, the push member has a first orientation with the stopper abutting the side wall of the base. In the first orientation, the conduit of the push member remains out of alignment with the spigot to preclude the flow of fluid therethrough. In a second orientation upon the depression of the second end of the push member, the conduit is maintained in alignment with the spigot to allow the flow of fluid therethrough. In the preferred embodiment, a spring 35 is situated within the sleeve and abuts the push member. The spring urges the push member into the first orientation.

Figure 5:
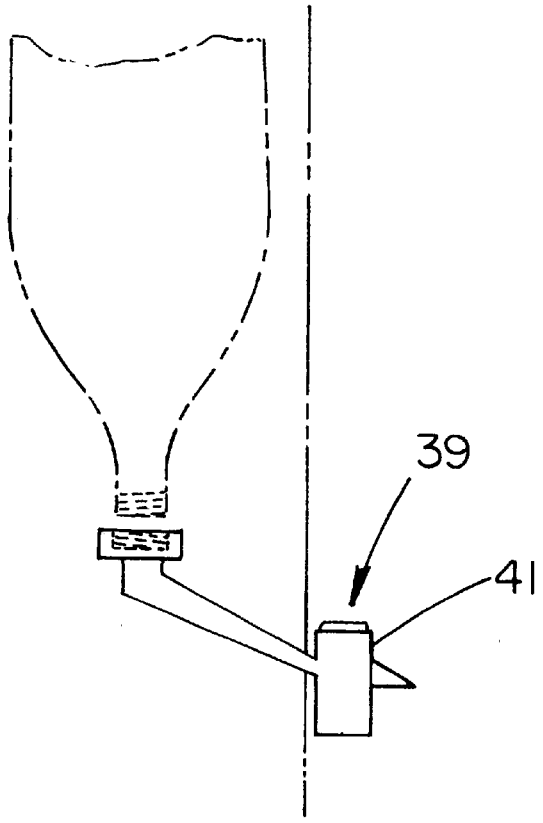
FIG. 5 is a side view of an alternate embodiment of the valve mechanism of the present invention.
Figure 6:
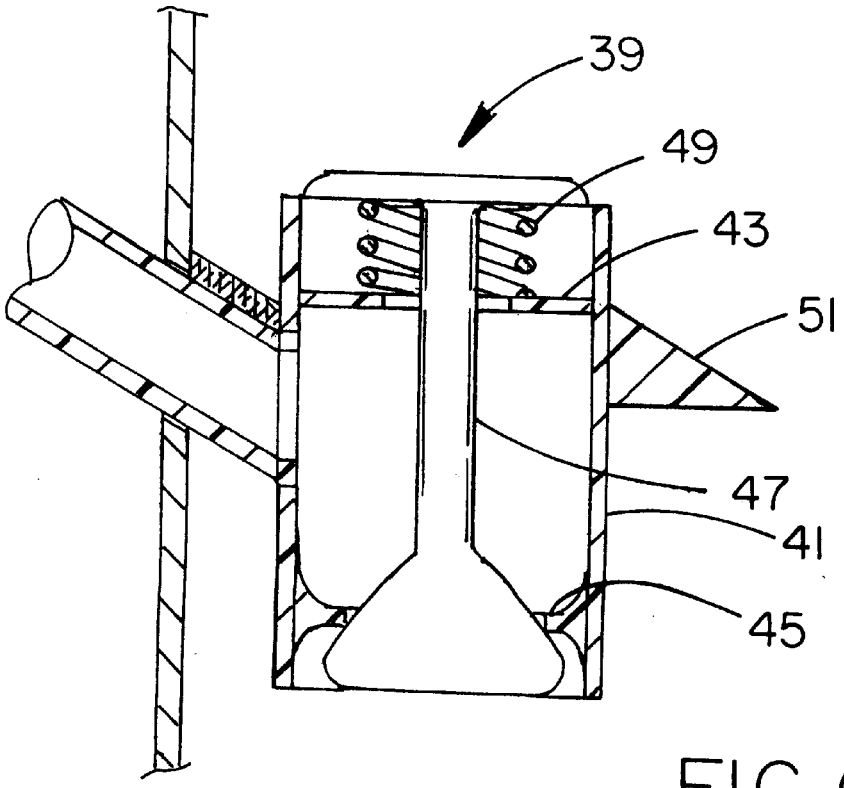
FIG. 6 is a side cross-sectional view of the valve mechanism shown in FIG. 5.

In an alternate embodiment 39, the valve mechanism includes a hollow cylinder 41 mounted at a central extent thereof to an end of the spigot. As shown in FIGS. 5 & 6, an upper annular flange 43 is mounted to an inner surface of the cylinder adjacent to and spaced from a top end of the cylinder and extends inwardly therefrom. Associated therewith is a lower annular flange 45 mounted to the inner surface of the cylinder adjacent to and spaced from a bottom end of the cylinder and extends inwardly therefrom. For reasons that will soon become apparent, the lower annular flange preferably has a converging cross-section along a radial length thereof. A vertically oriented plunger 47 is shown to include a planar circular top plate, a rod connected to the top plate and extending through the cylinder, and a bulbous bottom plug mounted to a bottom of the rod. Such bulbous bottom plug ideally has a generally frusto-conical top extent and a planar circular bottom face.

In use, the plunger has a lowered orientation for allowing the egress of fluid from the cylinder. In a raised orientation, the plunger is adapted for precluding the egress of fluid. The valve mechanism further includes a coil spring 49 positioned about the rod between the upper annular flange and the top plate of the plunger for urging the plunger into the raised orientation. A bushing preferably resides between the upper annular flange and the rod. Further, a latch 51 extends from the cylinder opposite the spigot for gripping purposes.

Figure 2:
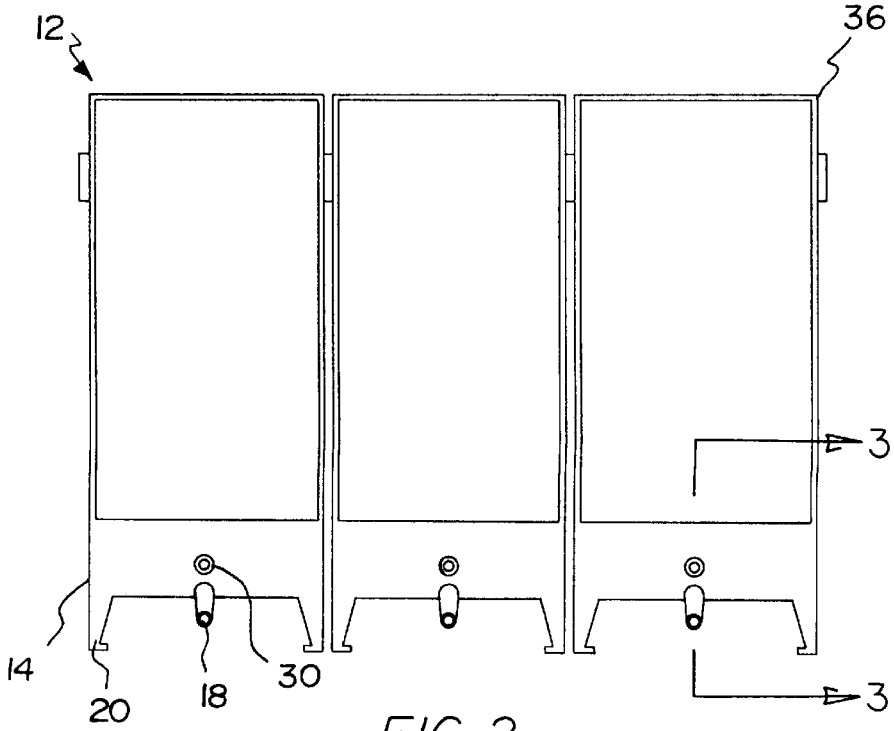
FIG. 2 is a front view of the dispensing assemblies of the present invention interconnected in a side-by-side relationship.

As shown in FIGS. 1 & 2, a frame 36 is mounted on the base of each dispensing assembly. Each frame includes four elongated stanchions 38 each mounted on one of four corners of the top face of the base. The stanchions extend upwardly from the base in a vertical direction. Connected between top ends of the stanchions are four short interconnect rods 40 which together define a square. Two adjacent stanchions have a vertically oriented clamp 42 mounted on a central extent thereof. Such clamps are each equipped with a C-shaped cross-section along their length. Another two adjacent stanchions each have a vertically oriented cylindrical post 44 mounted on their central extent.

Figure 4:
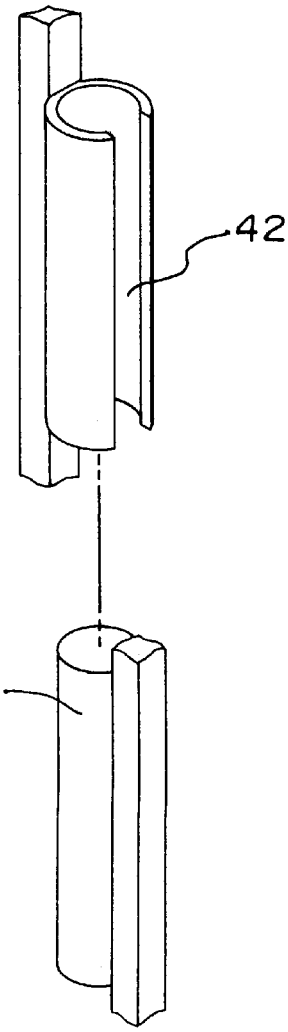
FIG. 4 is an exploded perspective view of the interconnection between the dispensing assemblies of the present invention.

By this structure, the dispensing assemblies are removably coupled in a side-by-side relationship by way of the couples in a manner illustrated in FIG. 4. When the dispensing assemblies are interconnected, the spigots preferably extend in a similar direction for convenient use. As such, various types of soda or other fluid may be dispensed in a favorable manner.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A soda dispenser system comprising, in combination:

a plurality of dispensing assemblies each including:

a base with a rectilinear configuration having a planar square top face, a planar square bottom face and a thin periphery formed of four side walls for defining an interior space, the top face of the base having a threaded recess formed therein with a tapering spigot having a top end coupled to a bottom of the threaded recess and extending downwardly and outwardly so as to exit the interior space of the base via a bottom edge of one of the side walls thereof and terminate in an open end, the bottom face of the base having four legs each mounted on one of four corners of the bottom face and extending downwardly therefrom, a valve mechanism including a bore formed in the side wall from which the spigot exits, a cylinder mounted at a central extent thereof to an end of the spigot, an upper annular flange mounted to an inner surface of the cylinder adjacent to and spaced from a top end of the cylinder and extending inwardly therefrom, and a lower annular flange mounted to the inner surface of the cylinder adjacent to and spaced from a bottom end of the cylinder and extending inwardly therefrom, and a vertically oriented plunger including a planar circular top plate, a rod connected to the top plate and extending through the cylinder, and a bulbous bottom plug mounted to a bottom of the rod, wherein the plunger has a lowered orientation for allowing the egress of fluid from the cylinder and a raised orientation for precluding the egress of fluid, the valve mechanism further including a coil spring positioned about the rod between the upper annular flange and the top plate for urging the plunger into the raised orientation; and a frame including four elongated stanchions each mounted on one of four corners of the top face of the base and extending upwardly therefrom and four interconnect rods connected between top ends of the stanchions to define a square, wherein two of the stanchions have a vertically oriented clamp mounted on a central extent thereof with a C-shaped cross-section along a length thereof and another two of the stanchions have a vertically oriented cylindrical post mounted on a central extent thereof;

wherein the dispensing assemblies are removably coupled in a side-by-side relationship with the spigots thereof extending in a similar direction.

2. A soda dispensing assembly comprising:

a base having an interior and a recess formed in the base for receiving a neck of an inverted soda bottle for receiving fluid from the bottle, a spigot conduit having a top end coupled to a bottom of the recess and extending from the recess and terminating in an open end, the base including a bore in communication with the spigot conduit; and a valve mechanism for selectively allowing fluid to flow from the end of the spigot conduit, the valve mechanism including a valve plunger member slidably mounted in the bore of the base and passing through the spigot conduit in a manner obstructing flow through the spigot conduit, a passage extending through the valve plunger member and having opposite openings, the valve plunger member having an open position permitting fluid flow through the spigot conduit and a closed position blocking fluid flow through the spigot conduit, the open position of the valve plunger member being characterized by each of the opposite openings of the passage being positioned in the spigot conduit and in fluid communication with the spigot conduit to permit fluid flow through the passage, the closed position of the valve plunger member being characterized by each of the opposite openings of the passage being positioned in said bore and out of fluid communication with the spigot conduit to prevent fluid flow through the passage, the valve mechanism including a biasing means for biasing the valve plunger member into the closed position;

wherein the spigot conduit has a substantially linear configuration, and the valve plunger member has a substantially linear configuration, and wherein an angle is defined between a longitudinal axis of the spigot conduit and a longitudinal axis of the valve plunger member, the angle being approximately 25 degrees.

3. A soda dispensing assembly as set forth in claim 2 wherein the valve mechanism includes a push button for allowing the flow of fluid upon the depression thereof, the push button being formed on an end of the valve plunger member extending out of the interior of the base.

4. A soda dispensing assembly as set forth in claim 2 wherein the base is substantially rectangular with a plurality of side walls, and includes a plurality of upstanding stanchions each mounted at an intersection of two of the side walls, a plurality of interconnect members connecting upper ends of the upstanding members, each linking member extending substantially parallel to one of the side walls.

5. A soda dispensing assembly as set forth in claim 2 wherein a plurality of soda dispensing assemblies are included each with couples mounted thereon for allowing the securement of the dispensing assemblies in a side-by-side relationship.

6. A soda dispensing assembly as set forth in claim 5 wherein the couples are positioned on frames mounted on top of the base of each dispensing assembly.

7. A soda dispensing assembly as set forth in claim 2 wherein the recess is threaded.

8. A soda dispensing assembly as set forth in claim 2 wherein the valve plunger member includes a retaining tab mounted thereon and being located in the interior of the base for resting against an interior surface of a side wall when the valve plunger member is in a closed position.

9. A soda dispenser assembly comprising:

a base having a top face, a bottom face and a periphery including four side walls for defining an interior space, the top face of the base having a threaded recess formed therein, a spigot conduit having a top end coupled to a bottom of the threaded recess, the spigot conduit extending generally downwardly and outwardly from the recess so as to exit the interior space of the base, the spigot conduit terminating in an open end;

a valve mechanism including a bore formed in the side wall from which the spigot conduit exits, a valve body with a substantially cylindrical chamber in communication with an end of the spigot conduit, an upper flange mounted to an inner surface of the chamber and extending inwardly therefrom, and a lower flange mounted to the inner surface of the chamber and extending inwardly therefrom at a location below the upper flange, and a plunger including a top plate, a rod connected to the top plate and extending through the chamber, and a bulbous bottom plug mounted to a free end of the rod, wherein the plunger has an open orientation for allowing the egress of fluid from the chamber and a closed orientation for blocking the egress of fluid from the chamber, the valve mechanism further including a coil spring positioned between the upper flange and the top plate for urging the plunger into the closed orientation; and a frame including four elongated stanchions each mounted on one of four corners of the top face of the base and extending upwardly therefrom and four interconnect rods connected between top ends of the stanchions.

10. A soda dispensing assembly as set forth in claim 9 wherein the bottom face of the base has four legs each mounted on one of four corners of the bottom face and extending downwardly therefrom.

11. A soda dispensing assembly as set forth in claim 9 additionally comprising linking assemblies for removably coupling more than one soda dispensing assemblies in a side-by-side relationship, the linking assemblies include a vertically oriented clamp mounted on a central extent of two of the stanchions, each of the clamps having a C-shaped cross-section along a length thereof and a vertically oriented cylindrical post mounted on a central extent of the other two of the stanchions.

* * * * *